United States Patent [19]

Munn

[11] Patent Number: 5,065,120

[45] Date of Patent: Nov. 12, 1991

[54] FREQUENCY AGILE, DIELECTRICALLY LOADED RESONATOR FILTER

[75] Inventor: Robert J. Munn, Albuquerque, N. Mex.

[73] Assignee: Motorola, Inc., Schaumburg, Ill.

[21] Appl. No.: 586,464

[22] Filed: Sep. 21, 1990

[51] Int. Cl.[5] ..... H01P 1/205

[52] U.S. Cl. ..... 333/207; 333/202; 333/134; 455/78

[58] Field of Search ..... 333/202, 206, 207, 222, 333/223, 235, 101, 103, 134; 455/78, 83, 77

[56] References Cited

U.S. PATENT DOCUMENTS

| | | | |
|---|---|---|---|
| 4,431,977 | 2/1984 | Sokola et al. | 333/206 |
| 4,459,571 | 7/1984 | Fraser | 333/202 |
| 4,462,098 | 7/1984 | D'Avello et al. | 370/30 |
| 4,692,724 | 9/1987 | Harris | 333/202 |
| 4,692,726 | 9/1987 | Green et al. | 333/206 |
| 4,714,906 | 12/1987 | D'Albaret et al. | 333/202 |
| 4,740,765 | 4/1988 | Ishikawa et al. | 333/206 |
| 4,742,562 | 5/1988 | Kommrusch | 333/202 X |
| 4,800,347 | 1/1989 | Yorita et al. | 333/202 |
| 4,800,348 | 1/1989 | Rosar et al. | 333/202 |

OTHER PUBLICATIONS

Microwave & RF Magazine, Oct. 1989, p. 150, Tunable Filter Varies Bandwidth, Center Frequency.

Electronics, Jul. 14, 1983, p. 129-131, by Tomoki Uwano, Ceramic-filled Resonator Cuts Costs of Radio-Telephone Filters.

RF Design Magazine, Mar. 1989, pp. 35-42, 129-131, by Darioush Agahi, Motorola, Inc., Monolithic Ceramic Block Combline Bandpass Filters.

Motorola, Inc., Technical Writing Services, No. 68P81049E82-D, Nov. 5, 1985, PHI, Trisolector Assembly and DYNA T-A-C Cellular Radiotelephone Transceiver Description.

*Primary Examiner*—Eugene R. LaRoche

*Assistant Examiner*—Seung Ham

*Attorney, Agent, or Firm*—Joseph P. Krause; Steven G. Parmelee; Anthony J. Sarli

[57] ABSTRACT

A frequency agile, dielectrically loaded bandpass filter is disclosed in which capacitive layers on the top surface of the filter are selectively switched to ground in order to affect a change in the center frequency of the passband response of the filiter. A PIN diode switching network, including a means for biasing the diode, is used to effectively place the capacitive layers in parallel with the quarter-wavelength transmission line resonators contained within the block of the filter.

15 Claims, 2 Drawing Sheets

-PRIOR ART-
100

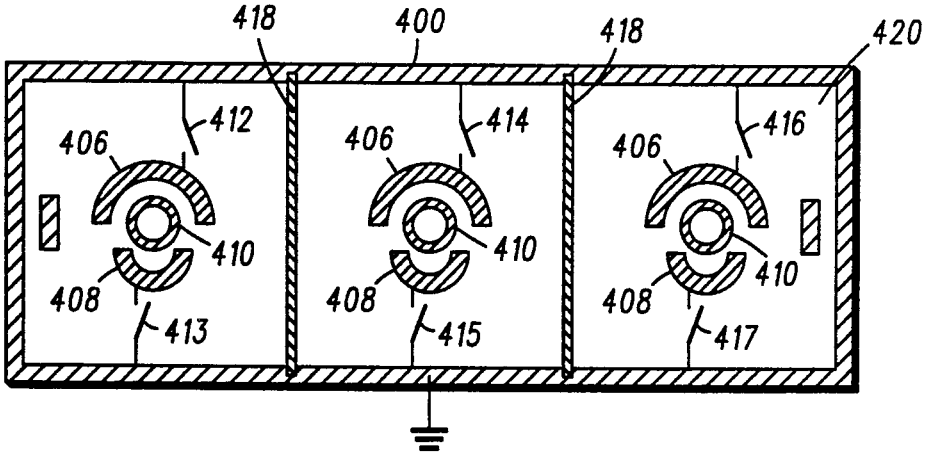
FIG. 4A
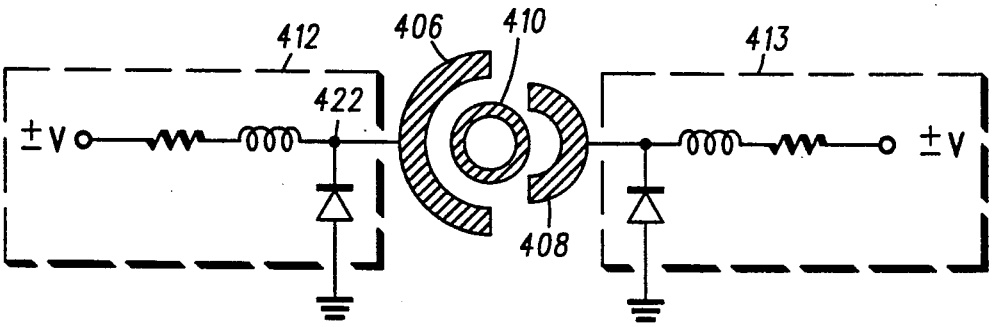
FIG. 4B
FIG. 5
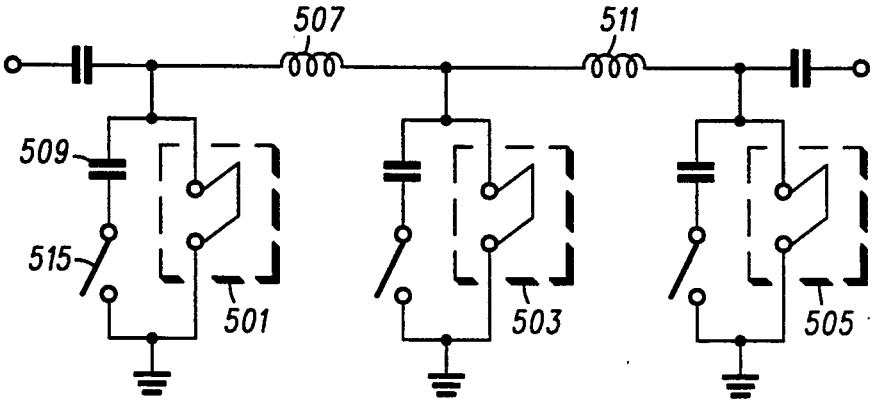

FREQUENCY AGILE, DIELECTRICALLY LOADED RESONATOR FILTER

FIELD OF THE INVENTION

The present invention relates generally to dielectric block filters, and more particularly relates to frequency agile dielectrically loaded resonator filters used in two-way communication systems. Reference is made to U.S. patent application No. 438,874, "Diode Bias Networks for Use With Voltage Controlled Oscillators", filed on behalf of Gehrke et al. on June 15, 1990, and to U.S. patent application No. 486,471 "Bandwidth Agile Dielectrically Loaded Resonator Filter", filed on behalf of Walker et al. on the same date herewith, each application assigned to the assignee of the present invention, and containing material which may be related to the present invention.

BACKGROUND OF THE INVENTION

Dielectric block bandpass filters, for example as in U.S. Pat. No. 4,431,977, "Ceramic Bandpass Filter", are commonly used as signal filters in communication systems, for example as in a conventional radio, transceiver, or radiotelephone. Conventonal dieletric filters off advantages in both physical and electrical performance which make them ideally suited for use in mobile and portable radio transceivers. Multi-resonator dielectric filters, as depicted in FIG. 1, typically comprise a plurality of quarter-wavelength transmission line resonators, constructed by making through-holes in the dielectric material, and plating these holes with a conductive material. In such a configuration, reactive coupling between adjacent resonators can be controlled by the physical dimensions of each resonator and by the orientation of each resonator with respect to the other resonators.

It is also commonplace to use diodes for electronically switching components in applications such as voltage controlled oscillators (hereinafter "VCO"), duplexers, and other areas where high speed switching is required. Voltage variable capacitors are also used for tuning in applications such as electronically tuned helical resonators, for example in U.S. Pat. No. 4,459,571, "Varactor-tuned Helical Resonator Filter".

The tuning of resonator loads is not a new idea, and such a resonant load may be a VCO, as in the aforementioned U.S. patent application No. 538,874. Unfortunately, such a configuration relies on relatively high voltage levels generated by the VCO in order to cause self-rectification in the diode switch, resulting in a reverse bias condition. In typical filter applications, there are not sufficient voltage levels to guarantee reverse biasing, hence the switch could never be in an 'off' state using this technique. Regarding the use of voltage variable capacitors, these devices typically offer very poor temperature stability, thereby requiring additional components for temperature compensation. The cost of adding these components can be significant when compared to the total cost of the filter. U.S. Pat. No. 4,800,348, "Adjustable Electronic Filter and Method of Tuning Same", shows the use of tuning networks which are mechanically trimmed to affect a change in the center frequency of the filter, but this process is typically a time consuming and costly process.

In short, shown solutions to the adjustment of the center frequency of bandpass filters used in communication systems, especially for miniaturized, dielectrically loaded resonator filters, are inadequate when an agile center frequency is desired. It would be advantageous to have one filter which could be electronically configured for use in multiple frequency bands, such as the case in a conventional cellular radiotelephone operating domestically at one frequency and at another frequency when operating in a foreign country. Clearly, there is a need for a temperature stable, electronically selectable center frequency bandpass filter which is not constrained by the aforementioned shortcomings.

SUMMARY OF THE INVENTION

The present invention encompasses a dielectrically loaded resonator filter having an electronically changeable center frequency of the filter. A hole extends from a first external surface toward a second external surface, the interior of which has a conductive coating to form a resonator at a predetermined center frequency. The conductive coating is coupled to a first conductive layer on the first external surface. A second conductive layer and a switch. The switch is coupled between the second conductive layer and a conductive coating disposed on at least the second external surface. The switch is further coupled to a biasing source, which may be a bipolar signal.

BRIEF DESCRIPTION OF THE DRAWINGS

FIG. 4A is a top view of a frequency agile dielectrically loaded resonator filter, according to the invention.

FIG. 4B is a more detailed view of one of the resonator sections of FIG. 4A.

FIG. 5 is a schematic diagram showing an equivalent circuit of a tunable dielectric filter, according to the invention.

DETAILED DESCRIPTION OF A PREFERRED EMBODIMENT

Figure 1:
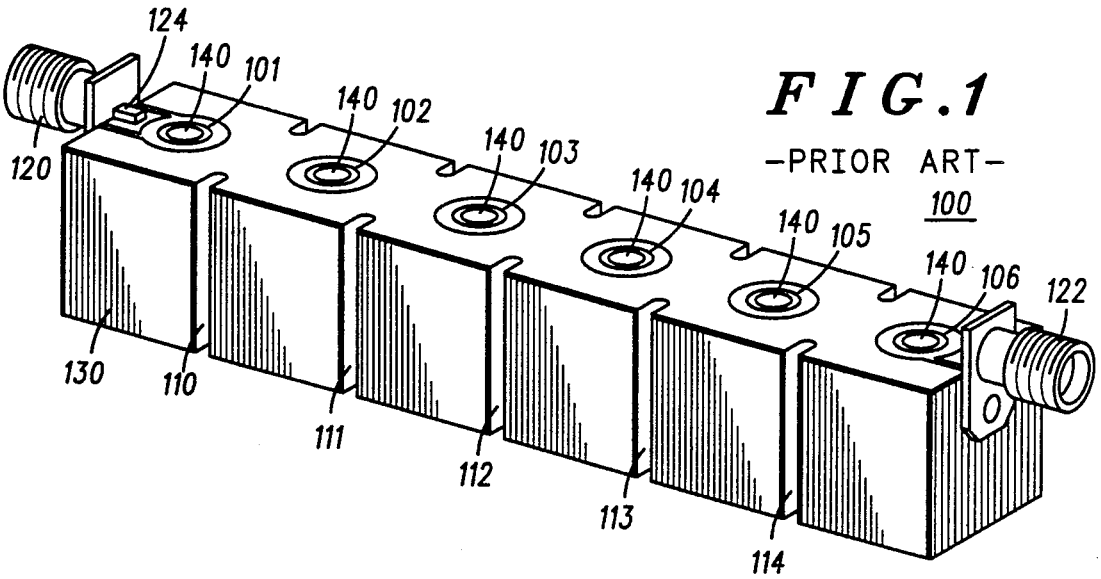
FIG. 1 is a perspective view of a conventional dielectric filter illustrating the orientation of the resonator elements and the input/output coupling.
Figure 2:
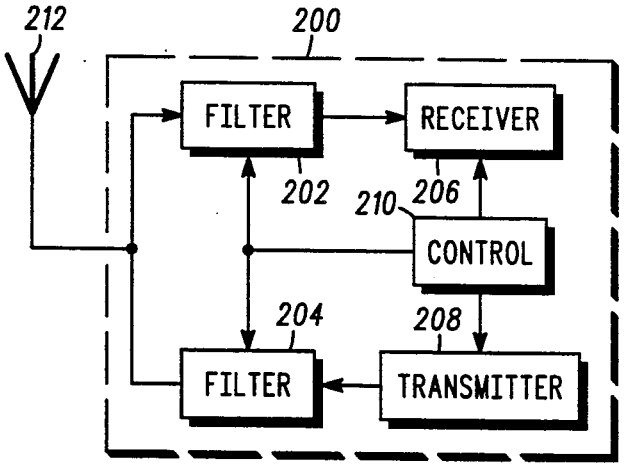
FIG. 2 is a block diagram of a radio employing the present invention.

FIG. 2 shows a simplified block diagram of a radio 200 where the invention may be employed. Using dielectric block filters on the front end of a radio is quite common. The radio 200, having a receiver 206, a transmitter 208, two front end filters 202 and 204, and a controller 210 used for selecting the desired center frequency of the filters, is coupled to an antenna 212. The radio 200, as shown in FIG. 2, is intended to represent a conventional communication system device which may include only a conventional receiver or only a conventional transmitter for one-way communication, or both for two-way communication.

Figure 3:
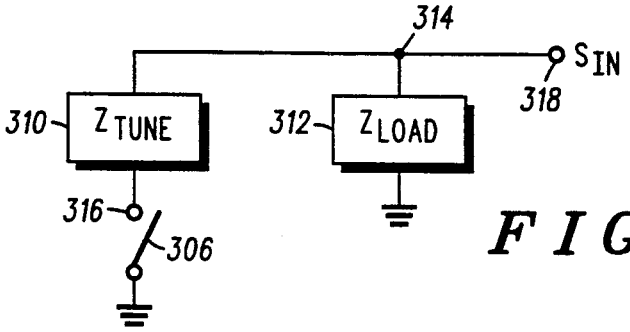
FIG. 3 is simplified schematic diagram illustrating the tuning of a resonator network by switching in a reactive network.

FIG. 3 shows a simplified schematic of how some of the aforementioned applications may be configured. In such a configuration, a signal 318 is imposed on node 314. Node 314 is connected to a resonant load 312, having predetermined frequency characteristics (ie. center frequency, bandwidth, etc.). Resonant load 312 is further connected to ground, as shown. A tuning network 310 is also connected to node 314. Tuning network 310 is also connected, via node 316, to one side of a switch 306, while the opposing side of switch 306 is connected to ground, as shown. When switch 306 is open, the effect of tuning network 310 is minimal and the aforementioned frequency characteristics of resonant load 312 remain unchanged. The closing of switch 306 provides tuning network 310 with a low impedance path to ground, effectively placing it in parallel with resonant load 312, resulting in a change in the center frequency of resonant load 312. Note that tuning network 310 may be either a capacitive or inductive network. Further note that switch 306 may be a diode, whose state of conduction is determined by a biasing voltage being applied to node 316. This diode may be, for example, a PIN type such as Hewlett Packard Part No. 4082-3900, which cathode is connected to node 316, and which anode is connected to ground.

FIG. 5 shows a simplified schematic of the preferred embodiment of the invention, specifically a 3-pole bandpass filter, having a predetermined center frequency. Note that all three resonators are represented schematically by their quarter-wavelength transmission line equivalents, for example resonator 501. In parallel with each resonator in a switch and a tuning capacitor, for example, switch 515 and capacitor 509 in parallel with resonator 501. Using resonator 501 for illustration, it can be seen that when switch 515 is open, capacitor 509 has little impact on the frequency characteristics of 501. Closing switch 515, on the other hand, places capacitor 509 in parallel with resonator 501, which in turn affects a resonant frequency shift in resonator 501. Similar frequency shifts occur for resonators 503 and 505, when their accompanying capacitors are switched to ground. Note that the coupling between adjacent resonators is almost purely inductive, and represented schematically by inductors 507 and 511. This is due to the suppression, through the use of grounding bars placed between the resonators, of the capacitive coupling which normally occurs on the surface of such filters.

In FIG. 4A there is illustrated a top view of the preferred embodiment of the invention. There is shown a block 400, generally constructed of a suitable dielectric material which has low loss, a high dielectric constant, and a low temperature coefficient of the dielectric constant. In the preferred embodiment of the invention, a ceramic material, having a height of 1.097 cm, a length of 8.10 cm, and a width of 2.06 cm, and dielectric constant of 37.3 was used. All surfaces of block 400 are completely coated with a conductive material, particularly a silver and glass paste in the preferred embodiment of the invention, with the exception of the top surface 420, which surfaces are then coupled to ground. Block 400 further has through holes which are coated with a conductive material, particularly silver and glass paste in the preferred embodiment of the invention, and coupled to the bottom surface. Each of these coated holes, when energized, behave like quarter-wavelength transmission line resonators, having predetermined frequency characteristics, which characteristics depend on the physical dimensions of the block and holes. Areas (hereinafter referred to as 'areas' or 'layers') 410 are metallized layers connected to the hole coating for each resonator of the filter (hereinafter referred to as resonant areas 410). Moreover, resonators are substantially collinear about a first fiducial line. Areas 406 are metallized layers in proximity with resonant areas 410, but not connected to resonant areas 410. Areas 408 are metallized layers, larger than areas 406, and in proximity with resonant areas 410, but not connected to resonant areas 410 or areas 406. Switches 412, 414, and 416 are used to ground areas 406, resulting in increased apparent capacitance to ground in parallel with each resonant area 410. Switches 413, 415, and 417 are used to ground areas 408, in order to further increase apparent capacitance to ground in parallel with each resonator. The top surface 420 is divided into four quadrants which are defined by the first fiducial line and a second fiducial line, for example one collinear with bar 418, extending between two resonants and perpendicular to the first fiducial line. Furthermore, areas 406 and 408 partially surround the resonant areas 410, and are disposed primarily within one of the four quadrants. Bars 418 are silver conducting bars to ground used to avoid undesired coupling between adjacent resonators of the filter, such as described in U.S. Pat. No. 4,692,726, "Multiple Resonator Dielectric Filter".

Looking at FIG. 4B, there is a more detailed look at how the capacitive areas 406 and 408 are switched to ground, using PIN diode switching networks 412 and 413, respectively, for a single resonator. Each of these PIN diode switching networks comprise a bipolar biasing voltage source, a current limiting resistor, an RF choke, and a PIN diode, which anode is grounded. The bipolar biasing voltage could be supplied in any one of a number of different ways, including a functional block similar to the controller 210 seen in FIG. 2. The current limiting resistor and RF choke are shown only to illustrate one way in which a bipolar signal can be properly applied to bias the PIN diode, without affecting the signal level. The switching is accomplished, for example between area 406 to ground, by applying a negative voltage to node 422. A negative potential, with respect to ground, at node 422, effectively forward biases the PIN diode, making it conductive, which gives capacitive area 406 a low impedance path to ground. The diode is turned 'off' by similarly applying a positive potential, with respect to ground, to node 422. This potential serves to reverse bias the PIN diode, rendering it non-conductive, giving capacitive area 406 no direct path to ground.

The following sequence describes how the frequency characteristics of one resonator are affected by switching the aforementioned areas to ground, even though the preferred embodiment of the invention calls for identical and simultaneous switching for all resonators comprising the filter. Since resonant area 410 is placed in parallel with either, neither, or both of areas 406 and 408 when they are switched to ground, it can be seen that there are four possible center frequencies which are electronically selectable. The first combination, resulting in the lowest possible center frequency, occurs when PIN diode switching networks 412 and 413 are both conducting. This places areas 406 and 408 in parallel with resonant area 410. The next higher frequency occurs when PIN diode switching network 412 only is conducting, placing area 406 in parallel with resonant area 410. The highest available center frequency of the filter response results when neither PIN diode switching network 412 nor 413 are conducting, resulting in virtually no additional capacitance being placed in parallel with resonant area 410.

I claim:

1. A frequency agile dielectrically loaded resonator filter having at least two external surface and a hole extending from a first of the two external surfaces toward a second of the two external surface, the frequency agile dielectrically loaded resonator having a conductive coating disposed on at least the second external surface and an interior surface of the hole to form a resonator at a predetermined center frequency, which predetermined center frequency may be changed, comprising:

a first conductive layer disposed on the first external surface and coupled to the conductive coating disposed on the interior surface of the hole;

a second conductive layer disposed on the first external surface and at least partially surrounding said first conductive layer;

first means for switching, coupled between said second conductive layer and the conductive coating disposed on the second external surface; and means for receiving and applying a bipolar signal for coupling to said first means for switching.

2. A dielectrically loaded resonator filter in accordance with claim 1 wherein the hole extends through from the first external surface to the second external surface.

3. A dielectrically loaded resonator filter in accordance with claim 1 wherein the conductive coating disposed on the second external surface is coupled to the conductive coating on the interior surface of the hole.

4. A dielectrically loaded resonator filter in accordance with claim 1 wherein said first means for switching includes a PIN diode.

5. A dielectrically loaded resonator filter in accordance with claim 1, further comprising a third conductive layer disposed on the first external surface.

6. A dielectrically loaded resonator filter in accordance with claim 5, further comprising second means for switching coupled to said third conductive layer and coupled to the second external surface.

7. A dielectrically loaded resonator filter in accordance with claim 6, wherein said means for receiving and applying a bipolar signal is coupled to said second means for switching.

8. A dielectrically loaded resonator filter in accordance with claim 7 wherein said second means for switching includes a PIN diode.

9. A dielectrically loaded resonator filter in accordance with claim 7, further comprising means for coupling said means for receiving and applying a bipolar signal to both said second and third conductive layers, whereby a plurality of center frequencies for said dielectrically loaded resonator filter may be realized.

10. A dielectrically loaded resonator block filter, comprising:

at least two resonators being substantially collinear about a first fiducial line, each of said resonators further comprising a hole which extends from a first surface of the dielectrically loaded resonator block filter toward a second surface of the dielectrically loaded resonator block filter, and having a conductive material disposed on an interior surface of each said hole, the first surface being divided into four quadrants which are defined by said first fiducial line and a second fiducial line extending between a first and a second of said at least two resonators and perpendicular to said first fiducial line;

a first conductive layer coupled to said conductive material;

a second conductive layer at least partially surrounding said first conductive layer and disposed primarily within one of said four quadrants;

means for coupling a first and second of said resonators, whereby a filter response is obtained;

a conductive coating disposed on at least said second surface; and means for switching coupled between said second conductive layer and said conductive coating.

11. A dielectrically loaded resonator block filter in accordance with claim 10, further comprising means, coupled to said means for switching, for coupling to a bipolar signal, whereby a different center frequency for said dielectrically loaded resonator block filter may be realized.

12. A dielectrically loaded resonator block filter, comprising at least two resonators being substantially collinear about a first fiducial line, each of said resonators further comprising a hole which extends from a first surface of the dielectrically loaded resonator block filter toward a second surface of the dielectrically loaded resonator block filter, wherein a conductive material is disposed on an interior surface of said holes, the first surface being divided into four quadrants which are defined by said first fiducial line and a second fiducial line extending between a first and a second of said at least two resonators and perpendicular to said first fiducial line, said dielectrically loaded resonator block filter further comprising:

a first conductive layer coupled to the conductive material;

a second conductive layer at least partially surrounding said first conductive layer and disposed primarily within one of said four quadrants;

means for coupling a first and second of said resonators, whereby a filter response is obtained;

a conductive coating disposed on all surfaces of the block filter, except the first surface;

means for switching coupled between said second conductive layer and said conductive coating; and a conductive strip disposed on the first surface substantially parallel to said second fiducial line, and connected to said conductive coating.

13. A dielectrically loaded resonator block filter in accordance with claim 12, wherein said means for switching further comprises means for coupling a bipolar signal, whereby a different center frequency for said dielectrically loaded resonator block filter may be realized.

14. A radio, comprising:

a receiver;

a dielectrically loaded resonator block filter, coupled to said receiver and comprising:

at least two resonators being substantially collinear about a first fiducial line;

means for coupling a first and second of said resonators, whereby a filter response is obtained;

a first conductive layer disposed on a first surface of said dielectrically loaded resonator block filter, said first surface being divided into four quadrants which are defined by said first fiducial line and a second fiducial extending between a first and a second of said at least two resonators and perpendicular to said first fiducial line, said first conductive layer being disposed primarily within one of said four quadrants;

means for coupling said first conductive layer to said first resonator; 'a conductive coating disposed on at least a second surface of said dielectrically loaded resonator block filter; and means for switching coupled between said first conductive layer and said conductive coating;

means for selecting at least one center frequency of said dielectrically loaded resonator block filter; and means for coupling said means for selecting to said means for switching.

15. A radio, comprising:

a transmitter;

a dielectrically loaded resonator block filter, coupled to said transmitter and comprising:

at least two resonators being substantially collinear about a first fiducial line;

means for coupling a first and second of said resonators, whereby a filter response is obtained;

a first conductive layer disposed on a first surface of said dielectrically loaded resonator block filter, said first surface being divided into four quadrants which are defined by said first fiducial line and a second fiducial line extending between a first and a second of said at least two resonators and perpendicular to said first fiducial line, said first conductive layer being disposed primarily within one of said four quadrants;

means for coupling said first conductive layer to said first resonator;

a conductive coating disposed on at least a second surface of said dielectrically loaded resonator block filter; and means for switching coupled between said first conductive layer and said conductive coating;

means for selecting at least one center frequency of said dielectrically loaded resonator block filter; and means for coupling said means for selecting to said means for switching.

* * * * *